US007882645B2

(12) United States Patent
Boring

(10) Patent No.: US 7,882,645 B2
(45) Date of Patent: Feb. 8, 2011

(54) SYSTEM AND METHOD FOR MAKING AN APPLIQUE

(76) Inventor: Colette R. Boring, P.O. Box 674, Clarksville, VA (US) 23927

( * ) Notice: Subject to any disclaimer, the term of this patent is extended or adjusted under 35 U.S.C. 154(b) by 756 days.

(21) Appl. No.: 11/890,637

(22) Filed: Aug. 7, 2007

(65) Prior Publication Data

US 2008/0029006 A1 Feb. 7, 2008

Related U.S. Application Data

(60) Provisional application No. 60/821,609, filed on Aug. 7, 2006.

(51) Int. Cl.
*B43L 7/00* (2006.01)
*G01B 3/14* (2006.01)
*D05B 97/00* (2006.01)

(52) U.S. Cl. ..... 33/562

(58) Field of Classification Search ..... 33/562, 33/563, 564, 565, 566
See application file for complete search history.

(56) References Cited

U.S. PATENT DOCUMENTS

| | | | | |
|---|---|---|---|---|
| 1,723,729 | A | 8/1929 | Goldberg | |
| 4,395,964 | A | 8/1983 | Warren | |
| 4,427,472 | A * | 1/1984 | Trager | 156/93 |
| 4,564,406 | A * | 1/1986 | Binks | 156/63 |
| 4,814,218 | A | 3/1989 | Shane | |
| 4,912,850 | A * | 4/1990 | Gray | 33/1 G |
| 4,945,642 | A * | 8/1990 | Saulietis | 33/17 R |
| 5,439,538 | A * | 8/1995 | Perry | 156/63 |
| 5,531,176 | A | 7/1996 | Johnson | |
| 6,443,081 | B1 * | 9/2002 | Quint | 112/475.18 |
| 6,925,724 | B2 * | 8/2005 | Tandy | 33/563 |
| 7,178,249 | B2 * | 2/2007 | Schafer et al. | 33/1 B |
| 2006/0005412 | A1 * | 1/2006 | Frawley | 33/566 |
| 2006/0032068 | A1 * | 2/2006 | Sherman et al. | 33/566 |

FOREIGN PATENT DOCUMENTS

| | | |
|---|---|---|
| JP | 07150409 A2 | 6/1995 |
| JP | 2004169238 A2 | 6/2004 |

* cited by examiner

*Primary Examiner*—Christopher W Fulton
(74) *Attorney, Agent, or Firm*—Guerry L. Grune

(57) ABSTRACT

A system, method and kit for making singular applique elements, combining the singular elements on a singular pattern as an aid for quickly and repeatably creating a combined element for attachment to a quilt, tablecloth, bedspread, pillow case, and the like. Two pre-printed paper sheets are provided having outlines of the applique elements printed wherein one paper sheet is cut into singular design elements and the other pre-printed sheet is of a coated nature that remains intact as a singular pattern. The singular design elements are applied to the applique fabric of which the fabric is cut to the shape of the singular element. The singular elements are then combined using the singular pattern as an assembly template ensuring a repeatable applique design. The combined applique elements can then be attached to the desired base material in a usual manner.

12 Claims, 2 Drawing Sheets

SYSTEM AND METHOD FOR MAKING AN APPLIQUE

Applicant hereby claims priority under all rights to which they are entitled from application 60/821,609, filed Aug. 7, 2006 and titled "System and Method for Making an Applique"

FIELD OF INVENTION

The present invention relates to a method for making an applique to be applied as a decorative overlay on a larger fabric, or on a fabric covered article. More particularly, the present invention relates to a system for an improved, repeatable method for making an applique with detailed designs.

BACKGROUND OF INVENTION

Applique designs are commonly provided as decorative elements on various types of fabric articles, such as quilts, tablecloths, bedspreads, pillow cases, and the like.

Traditionally, applique elements have been made and applied by hand, wherein the technique required tracing pattern lines onto a sheet of paper or the like, cutting out the pieces of the pattern from the tracing and tracing onto the back surface of the applique material to achieve the outline of the applique pattern piece. Overall applique design may be as simple as one element or include a number of individual applique elements that are to be combined to provide the overall design.

An amount of fabric for a seam is desired around the outer periphery of the traced applique element. The element is then cut from the fabric sheet and the seam allowance is folded over along the traced outline shape of the element and is basted together with the other elements. The resulting composite applique element is then arranged in position on the base material to which it is to be attached to form the final applique design on the base material.

Because the traditional method for making the applique elements including tracing, cutting, arranging and providing finished edges by basting is so slow, various different approaches have been devised to facilitate the preparation of such applique elements, and to reduce the time involved in preparing them. One such different approach involved the use of preformed templates defining the outlines of the several applique elements, both with and without the seam allowance. The templates are often made from either a thick plastic sheet that has a thickness greater than that of a limp film, or from a heavy paper sheet that has sufficient weight to be substantially self-supporting.

A template that includes seam allowance is placed over the fabric sheet from which the applique element is to be formed, and is secured thereto temporarily either by tape or by means of a readily releasable adhesive, after which the pattern for the applique element is cut from the fabric, along with the desired seam allowance. The element is then either sewn to a second template without the seam allowance, if the material is paper, or alternatively, it can be attached using water-soluble glue. The resulting applique element is then stitched to the base material, which has had a pattern drawn on it using the smaller template, without the seam allowance, the outline of the applique element. The smaller template is later removed by cutting the base material that is positioned under the applique element. The smaller template is within the periphery of the element, and separating the paper or plastic template from the applique element and withdrawing it from between the applique material and the base material finalizes the process.

Other ways that have been devised for holding the seam allowances in place include the application of a spray starch to the fabric portion of the seam allowance and then ironing the seam allowance over the reverse side of the applique element or over a previously-cut paper template placed on the reverse side of the applique element fabric. Additionally, the use of a so-called "freezer paper", having a heat softenable coating, has been suggested with the coating surface of the template facing upwardly so that the folded over fabric seam allowance can be ironed directly to the coated surface of the freezer paper.

Various techniques are disclosed in the Background of the Invention section of U.S. Pat. No. 5,141,140, to Deborah J. Moffett-Hall, issued Aug. 25, 1992.

One of the more intricate aspects of appliques is to combine detailed reproduced works of art, such as by a favorite artist, with applique techniques. There is a large margin of reproducibility error associated with combining the single pattern piece elements in to the combined element applique. Fitting of the separate pattern piece elements repeatably consumes much time and patience and is rarely consistent.

A definition that is common in the applique, sewing and quilting art regarding fabric is that the fabric portion that is the most desirable side is defined as the right side (RS) and the least desirable side is definably the wrong side (WS) whereupon positioning of the fabric is noted by right side up (RSU) or wrong side up (WSU) when placed upon another object and within sight of the user. Definably the completion of an applique on a quilt, tablecloth, bedspread, pillowcase, and the like is (RSU).

Although some of the alternative techniques for preparing applique elements significantly speed the process, as compared with the traditional method involving tracing and basting, they still involve excessive time and allow for error in replicating detailed applique designs. It is therefore an object of the present invention to provide an improved system and method for making a detailed composite applique element that is repeatable from panel to panel.

DESCRIPTION OF PRIOR ART

U.S. Pat. No. 5,531,176 to Johnson, Adrienne M., and unassigned describes a method for preparing an applique element having a desired shape for attachment to a fabric base material. Provided is a sheet of flexible fabric material, a paper sheet having printed thereon in a non-transferable ink an outline of a shape element of which a fabric pattern element is to be made, wherein the paper sheet includes on one face thereof a heat softenable coating having a softening temperature greater than normal room temperature, cutting the paper sheet along the printed outline to separate the shape element from the paper sheet and provide a paper template having a coated face and an uncoated face, placing the paper template on the flexible fabric sheet with the coated face of the template against the back face of the fabric sheet and with the uncoated paper face of the paper template facing outwardly. Heat and pressure are applied substantially uniformly over the uncoated face of the template to soften the heat softenable coating without transfer of ink from the paper template to the fabric sheet to releasably adhere the coated face of the template to the fabric sheet. A layer of releasable adhesive is applied along the outer peripheral edge portion of the uncoated face of the paper template and along an adjacent portion of the fabric sheet adjacent the peripheral edge of the paper template to provide a substantially continuous strip of adhesive coated surface on the paper template adjacent to the peripheral edge of the uncoated face of the paper template and on the fabric sheet outwardly of and adjacent to the peripheral edge of the paper template and cutting the fabric sheet around the peripheral edge of the paper template at a substantially uniform, predetermined spacing therefrom to provide a fabric seam allowance around and outwardly of the periphery of the paper template. The fabric is then folded over the fabric seam allowance on the peripheral edge of the paper template and against the paper template on the uncoated face thereof to adhere the adhesive coated surface portion of the fabric sheet to the adhesive coated surface portion of the peripheral edge of the paper template to provide an applique element; and attaching the applique element to the fabric base material.

U.S. Pat. No. 1,723,729 to Goldberg and unassigned describes an applique article comprising, a base fabric, and a cut design of a textile fabric, attached thereto, with the design being coated on the side facing the base fabric, substantially, completely with a thread fraying preventive coating.

U.S. Pat. No. 4,395,964 to Warren, Marjory A., and unassigned describes a method of making patchwork articles from pieces of textile fabric, including the steps in a sequence: (a) forming an overall design in visible lines on flexible paper, the visible lines forming a large plurality of closed geometric shapes whose borders are common, the overall design corresponding in shape, size and design to a final patchwork article, marking visible indicia of location in the overall pattern on each of the closed shapes, cutting along the lines to form a plurality of individual paper patterns each being a closed shape, using each of the paper patterns to cut one fabric piece, each piece having a border which extends entirely around and beyond the paper pattern from which it was cut, folding the borders of the fabric piece over the edges of the paper pattern, and joining each fabric piece by temporary stitches to the paper pattern from which it was cut and joining the fabric pieces based upon the indicia on the paper patterns to duplicate in the patchwork article the pattern of the original overall pattern and removing the temporary stitches and paper patches from the fabric pieces.

U.S. Pat. No. 4,814,218 to Shane, Barry, and assigned to JMC Black Inc., describes a quilted craft article comprising a substrate having on a surface thereof defining a pattern of the quilted article and defining individual sections of the pattern with slits formed in the substrate extending partially into the substrate, along the lines and pieces of fabric, larger than the sections, defining excess material, each piece of fabric corresponding to one section and each piece of fabric being attached to the substrate by the excess material of the piece of fabric being grippingly held within the slits surrounding each corresponding section.

Japanese Patent Publication No. JP07150409A2 to Namima, et. al., and assigned to Bunka Gakuen, describes a method for producing clothes comprising a forming paper or sheet having solubility in liquids arranging one selected from various materials such as yarn, string, ribbon, tape, piece of cloth or leather or plural kinds of optionally combined materials of an optional design on one paper pattern thereof, covering the paper pattern with another paper pattern, superposing the three, then integrally machine-sewing required places thereof such as quilting, thereby constituting a paper pattern material laminate in which the internal material is sewn and fastened at the place thereof and fixed in an integral fabric state, similarly constituting paper pattern material laminates in other parts, collecting the paper pattern material laminates of the respective parts, mutually machine-sewing required edge parts, joining the laminates together, thereby providing a material in the shape of clothes, then dipping the resultant material in the shape of the clothes in a liquid, dissolving and removing the paper patterns.

Japanese Patent Publication No. JP2004169238A2 to Muraki Sachiyo, and unassigned, describes a paper pattern set for unit patchwork for cutting a base cloth constituting the unit motif, a patch cloth and a cloth to form a domet core is provided with a paper pattern for cutting the base cloth as the base pattern. Another paper pattern for folding the base cloth, a paper pattern for cutting the patch cloth, a paper pattern for folding the patch cloth and a paper pattern for cutting the domet core. The pattern set is further provided with divided base cloth cutting paper patterns and divided patch cloth cutting paper patterns produced by dividing the base cloth or patch cloth, or the base cloth and the patch cloth into two parts. The paper pattern has an additional line for the rough standard of alignment.

SUMMARY OF THE INVENTION

The preferred embodiment of the invention is a system for preparing a numbered applique pattern piece template to determine the shape of a selected fabric, tracing, numbering, lettering and cutting out the unique tracing shape, applying the unique template shape to the fabric and cutting the fabric shape to replicate the shape of the template, applying an adhesive coating to a surface of the fabric, individually numbering a unique corresponding template number, creating additional template and fabric shapes with an adhesive coating to one of the fabric surfaces and consecutively numbering the unique shapes, placing the fabric shapes over a numbered releasable pattern guide and then matching the numbers with the fabric pieces to determine an exacting fabric placement. Next, adhering the fabric pieces in the proper numbered order and in relationship to each other to create a combined applique element such that the use of the uniquely numbered template pieces and the uniquely numbered releasable pattern ensures a repeatable combined applique element design.

An additional embodiment is a method for preparing a numbered applique pattern piece template to determine the shape of a selected fabric, tracing, numbering, lettering and cutting out the unique tracing shape, applying the unique template shape to the fabric and cutting the fabric shape to replicate the shape of the template, applying an adhesive coating to a surface of the fabric, individually numbering a unique corresponding template number, creating additional template and fabric shapes with an adhesive coating to one of the fabric surfaces and consecutively numbering the unique shapes, placing the fabric shapes over a numbered releasable pattern guide and then matching the numbers with the fabric pieces to determine an exacting fabric placement. Next, adhering the fabric pieces in the proper numbered order and in relationship to each other to create a combined applique element such that the use of the uniquely numbered template pieces and the uniquely numbered releasable pattern ensures a repeatable combined applique element design.

In another embodiment is a kit for providing a numbered applique pattern piece template to determine the shape of a selected fabric, instructions to cut the pattern piece template into various designs and shapes, applying the template design or shape to the fabric and cutting the desired fabric shape to replicate the shape of the template, applying an adhesive coating to a surface of the fabric, numbering a corresponding template number, creating additional template and fabric shapes with an adhesive coating to one of the fabric surfaces, placing the fabric shapes over a provided numbered releasable pattern guide such that matching the numbers with the fabric pieces to determine an exacting fabric placement takes place. Next, adhering the fabric pieces in the numbered order and in relationship to each other to create a combined applique element can be obtained using a kit providing numbered template pieces and a numbered releasable pattern to ensure a repeatable combined applique element design.

An embodiment of the invention is to provide a numbered pattern pieces sheet and numbered releasable pattern guide wherein the numbered pattern pieces sheet and the numbered releasable pattern guide are numbered so as to identically place numbered pattern pieces that are cut into shapes to the numbers and shapes of the releasable numbered pattern guide for repeatably creating a combined element applique.

An embodiment of the invention is to provide a numbered pattern pieces sheet and numbered releasable pattern guide wherein the numbered pattern pieces sheet represents a section of the applique pattern and numbered releasable pattern guide represent an individual section of combined applique elements.

Another embodiment of the invention is to provide a numbered pattern pieces sheet section and numbered releasable pattern guide section wherein the numbered pattern pieces sheet section and numbered releasable pattern guide section are constructed so as to allow each section to be repeatably placed and attached combinably together to construct a complete combined applique design or pattern.

Additionally an embodiment includes a numbered releasable pattern guide that has a releasable surface such that when the individual pattern pieces are placed thereon and heat and pressure are applied for a sufficient amount of time, the individual pattern pieces adhesively bond to each other forming a combined element applique whereupon cooling of the combined element applique to a temperature of between 45 degrees F. to 100 degrees F., or thereabouts, releases the combined element applique from the releasable surface of the numbered releasable pattern guide.

Additionally an embodiment is to place a shaped fabric pattern piece right side up (RSU) upon a low temperature, heat softenable adhesive sheet or film, with the adhesive in contact with the wrong side (WS) wherein heat is applied with a heated pressing iron device or the like with sufficient heat, pressure and time to melt the low temperature adhesive on and into the wrong side (WS), whereby sufficient cooling of the fabric, below the thermal melting point of the adhesive, the fabric is removed from the heat softenable adhesive sheet or film with sufficient adhesive attached to the wrong side of the shaped fabric pattern piece.

An additional embodiment is to provide a kit for preparing a pattern piece element combining one or several pattern piece elements into a specific combined element applique. The kit comprising:

Specific and general directions

Numbered pattern pieces sheet

Fusable bond paper

Insert cover picture of a completed applique design

Stylus or writing instrument

Dressmakers tracing paper

Fabric

Batting

Backing fabric

Resealable plastic bag

Numbered Releasable Pattern Guide

Individual section guide

DETAILED DESCRIPTION OF THE DRAWINGS

Figure 1:
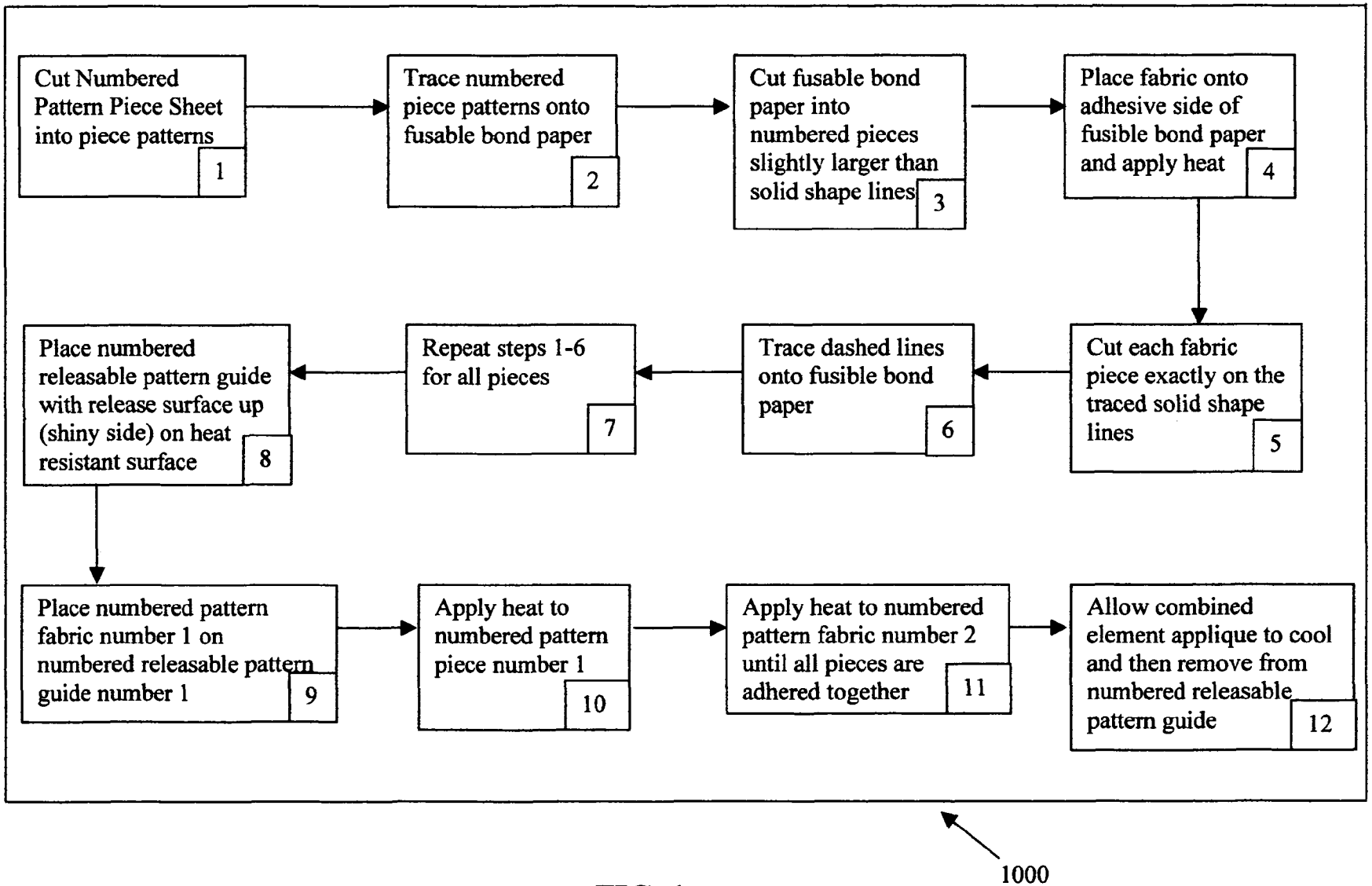
FIG. 1 is a flow chart of the applique construction system.

FIG. 1 is a flow chart of the applique construction system [1000].

Figure 2:
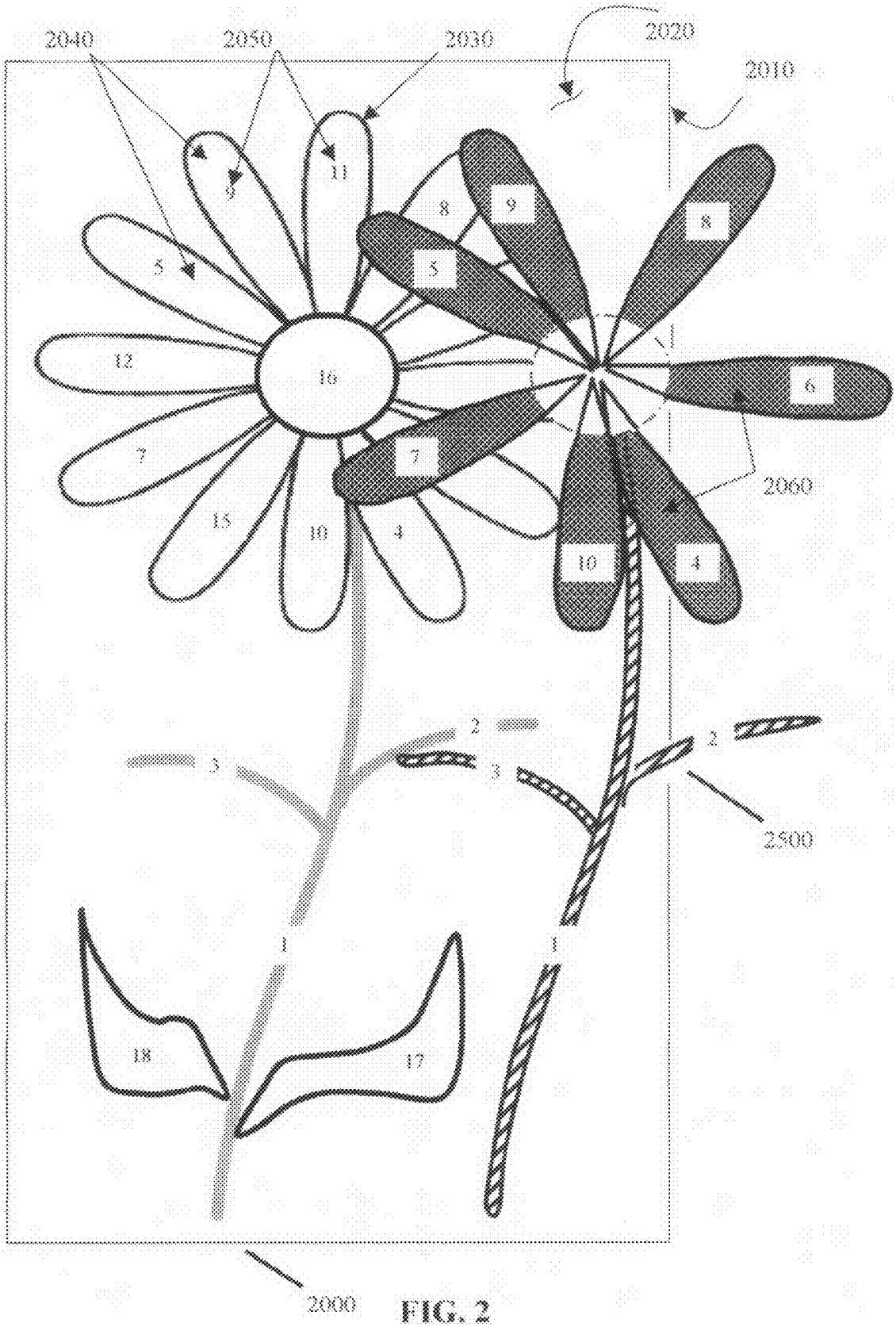
FIG. 2 drawing of the numbered releasable pattern guide and a partially completed applique.

FIG. 2 shows the numbered releasable pattern guide [2000] of FIG. 1, steps 8-12, showing a partially completed applique [2500] of fabric pattern pieces [2060]. The numbered releasable pattern guide [2000] is a translucent or transparent sheet having a first surface [2010] of bond paper, kraft paper, film, polyester, polyethylene, parchment or the like and a second surface [2020] of a shiny smooth texture of silicon composition or high temperature waxes. The first surface [2010] has a printed pattern [2030] representing a complete pattern or pattern section having individual pattern pieces [2040] with individual numbers [2070] consecutively ordered in a manner of desired applique construction. The numbered releasable pattern guide [2000] may have numbers [2070] from 1-n and/or letters depending on the complexity and/or coloring of the printed pattern [2030].

The second surface [2020] characteristics are such that the fabric pattern pieces [2060], do not stick to the numbered releasable pattern guide [2000] when heat and pressure is applied. The fabric pattern pieces [2060] are comprised of a selected fabric and a low melt adhesive. Accordingly, the construction of the fabric pattern pieces [2060] are described below in Steps 1-10.

The numbered releasable pattern guide [2000] is placed with the second side [2020] as an available surface for placing the fabric pattern pieces [2060] thereon with the user matching the fabric pattern pieces [2060] numbers to the numbered releasable pattern guide [2000] numbers. The fabric pattern pieces [2060] are placed right side up (RSU) in the sequence dictated by the numbered releasable pattern guide [2000]. Heat and pressure are applied by a fabric ironing device [not shown] to the individual fabric pattern pieces [2060] thereby melting the adhesive of each fabric pattern piece [2060] and adhering them to adjacent fabric pattern pieces [2060]. Applying this process creates the partially completed applique [2500] of fabric pattern pieces [2060] numbered 1-10. A completed applique for this illustration would include fabric pattern pieces 1-18.

Instructions for Using the Perfect Placement System

A. Preparing Pattern Pieces

1. Read the instructions provided in the applique package.
2. Remove the numbered pattern pieces template sheet from package.
3. Do not cut pattern pieces from sheet. These are reusable pattern pieces since all you do is trace them. Just trace around each pattern piece by placing the fusible bond paper on top of the pattern piece template sheet and trace exactly including the dotted lines, pattern numbers and if included in pattern the suggested color value. Ex B=bright, L=light, D=dark, M=medium.
4. Cut the traced fusible bond paper with the numbered pattern pieces now traced on with about a ¼" allowance around.
5. Select your fabric using the insert cover picture as a guide.

6. Place the fabric wrong side up on an ironing surface, and place the fusible bond paper cutout on the wrong side and with an iron set to the recommended setting, fuse each pattern piece onto the wrong side of desired fabric.
7. Cut the fused fabric following the solid lines you traced for each piece. Caution: careful cutting is very important!
8. Place the dressmaker's tracing paper marking side up on a table-top or other hard smooth surface and the fused fabric cut out paper side up on top of the dressmaker's tracing paper.
9. Press each of the dotted lines on each piece using a pencil or stylus being as accurate as possible.
10. Once each piece has the dressmakers tracing dotted lines on it, place each piece in a resealable plastic bag so they don't get lost as you work.

B. Placement of Pieces Using the Numbered Releasable Pattern Guide

1. Place the numbered releasable pattern guide shiny side up (this is the releasable side) on a heat resistant surface such as an ironing board.
2. Prepare a medium hot pressing iron and with light pressure fuse each piece.
3. Place pattern piece numbered 1 on placement guide number 1.
4. Fuse with medium iron and light pressure.
5. Following the number order of the numbered releasable pattern guide, place each fused fabric piece in alignment on the corresponding guide number and repeat steps 4 and 5 until all the pattern pieces are fused together into a completed applique or applique section.
6. With all the fused pieces in place and cooled, peel the entire fused completed applique or applique section from the Numbered Releasable Pattern Guide.
7. Place your background fabric right side up and, referring to the insert cover picture, place the completed applique or applique section right side up in the desired location on the background fabric.
8. Iron the completed applique or applique section using medium heat and light pressure to fuse the completed applique or applique section to the background fabric.
9. For applique sections, complete fusing each section then combine the sections on the background fabric following steps 7 & 8.
10. Sew along each raw edge of each fused piece using the zigzag stitch or satin stitch on your sewing machine. Use your choice of color and type of thread.

For Clothing or Other Accessories—Go to Section D

Completing the Applique for Wall Quilts and Bed Quilts

C. Creating the Quilt Sandwich

1. Place your desired backing fabric on a flat surface wrong side up. This fabric needs to be about 3" larger than the completed fused design.
2. Tape the corners to the flat surface.
3. Cut the batting (filler) material the same size as the backing fabric.
4. Place on top of the wrong side of taped backing fabric.
5. Smooth out any wrinkles.
6. In the desired location, lay the completed applique or applique section right side up on top of the backing fabric and batting material.
7. Smooth out flat.
8. Pin-baste the layers together and sew the background fabric, batting material and backing fabric in the desired pattern.
9. Sew around entire quilt sandwich allowing for a ¼" seam using a walking foot.
10. Sew binding as desired.

Completing the Applique for Clothing or Other Accessories

D. Applying the Applique

1. Place selected clothing or accessory on a heat resistant surface right side up.
2. Place completed applique or applique section in desired location.
3. Smooth clothing or accessory and applique flat and iron using medium heat and light pressure to fuse the completed applique or applique section to the clothing or accessory.
4. Sew along each pattern piece in each section using a zigzag stitch or satin stitch if the article will be laundered often.

What is claimed is:

1. An applique pattern guide system comprising; a printed translucent pattern guide sheet with a top surface and a bottom surface wherein said sheet top surface has releasable characteristics and the print on said pattern guide sheet defines a pattern defined by numbered unique shapes providing a numbered template displayed on said top surface of said guide sheet, wherein an adhesive coating is initially applied to a back portion of one surface of at least two or more pieces of fabric, said at least two or more pieces of fabric created from more than one corresponding and unique fabric shapes said fabric shapes resulting from cutting along the perimeter outline of said unique fabric shapes providing unique fabric pieces, and subsequently using said pattern guide sheet by placing said unique fabric pieces onto said pattern guide sheet allowing for matching the numbers associated with said fabric pieces;

further allowing for aligning and adhering said fabric pieces in the proper numbered order and proper spatial relationship so that each of said fabric pieces are exactly placed;

creating a unique combined and repeatable patterned applique element.

2. The applique pattern guide system of claim 1, wherein said unique combined and repeatable patterned applique element comprises unique fabric shapes individually and consecutively numbered wherein all said unique shapes are themselves numbered.

3. The applique pattern guide system of claim 1, wherein said unique combined and repeatable patterned applique element is itself a complete applique pattern or an applique section that can be part of a complete pattern.

4. The applique pattern guide system of claim 3, wherein a completed applique or said applique section is removed from said surface of releasable characteristics as a single applique design.

5. The applique pattern guide system of claim 1, wherein said numbered unique shapes providing a numbered template displayed on said top surface of said guide sheet correspond to a numbered pattern pieces template of unique template shapes and template numbers wherein a fusible bond paper is cut to conform to said unique template shapes providing an adhesive surface for a selected fabric wherein fusible bond paper and said selected fabric are fused together and subsequently cut to conform to complete unique fabric shapes with an adhesive surface.

6. The applique pattern guide system of claim 5, wherein heat and pressure are applied to said unique fabric pieces activating the adhesive of said fusible bond paper wherein unique fabric pieces are subsequently adhered to each other by activating said adhesive using heat and pressure whereupon adhering all said fabric pieces completes an applique pattern or applique section.

7. The applique pattern guide system of claim 1, wherein said pattern guide sheet is either translucent or transparent.

8. The applique pattern guide system of claim 1, wherein said printed pattern consists essentially of one or more of the following methods; offset, lithography, letterset, engraving, thermography, inkjet, photocopy, gravure, screen printing, and foil stamping.

9. The applique pattern guide system of claim 1, wherein said pattern guide system consists essentially of: paper, film, polyester, polyethylene, and parchment.

10. The applique pattern guide system of claim 1, wherein said surface of releasable characteristics comprises silicones, and waxes.

11. An applique pattern guide kit comprising; providing a printed translucent pattern guide sheet with a top surface and a bottom surface wherein said sheet to surface has releasable characteristics and the print on said pattern guide sheet defines a pattern defined by numbered unique shapes providing a numbered template displayed on said top surface of said guide sheet.

12. The applique pattern guide kit as in claim 11, wherein said applique pattern guide kit comprises the following elements: specific and general directions, a numbered pattern pieces sheet, fusible bond paper, an insert cover picture of a completed applique design, a stylus or writing instrument, dressmakers tracing paper, fabric, batting, backing fabric, a resealable plastic bag, said pattern guide sheet, and an individual section guide or any combination of one or more of said elements wherein use of said kit enables the creation of a unique combined and repeatable patterned applique element.

* * * * *